US006418729B1

(12) United States Patent
Dominguez-Alonso et al.

(10) Patent No.: US 6,418,729 B1
(45) Date of Patent: Jul. 16, 2002

(54) DOMESTIC REFRIGERATOR WITH PELTIER EFFECT, HEAT ACCUMULATORS AND EVAPORATIVE THERMOSYPHONS

(75) Inventors: Manuel Dominguez-Alonso; Juan Manuel Pinillos Perez; Carmen Garcia Rodriguez; Pedro Gutierrez Guardiola, all of Madrid (ES)

(73) Assignee: Consejo Superior de Investigaciones Cientificas, Madrid (ES)

( * ) Notice: Subject to any disclaimer, the term of this patent is extended or adjusted under 35 U.S.C. 154(b) by 0 days.

(21) Appl. No.: 09/700,508

(22) PCT Filed: May 14, 1999

(86) PCT No.: PCT/ES99/00138

§ 371 (c)(1),
(2), (4) Date: Jan. 23, 2001

(87) PCT Pub. No.: WO99/58906

PCT Pub. Date: Nov. 18, 1999

(30) Foreign Application Priority Data

May 14, 1998 (ES) ..... 9801016

(51) Int. Cl.[7] ..... F25B 21/02
(52) U.S. Cl. ..... 62/3.6; 63/3.7; 63/3.2
(58) Field of Search ..... 62/3.6, 3.7, 3.2

(56) References Cited

U.S. PATENT DOCUMENTS 5,522,216 A * 6/1996 Park et al. ..... 62/3.6
5,605,047 A * 2/1997 Park et al. ..... 62/3.6
5,845,497 A * 12/1998 Watanabe et al. ..... 62/3.6
5,927,078 A * 7/1999 Watanabe et al. ..... 62/3.6
6,003,319 A * 12/1999 Gilley et al. ..... 62/3.7
6,029,471 A * 2/2000 Taylor ..... 62/453

* cited by examiner

*Primary Examiner*—William C. Doerrler
*Assistant Examiner*—Mark Shulman
(74) *Attorney, Agent, or Firm*—Laurence A. Greenberg; Werner H. Stemer; Ralph E. Locher

(57) ABSTRACT

The invention relates to refrigerating installations of which the operation is based on the combination of Peltier effect producer elements and thermosyphons with liquid-vapor phase change. Basically it is comprised of: 1) Refrigeration container, 2) Heat dissipator, 3) Closed and fluid-tight circuit containing a fluid which boils or evaporates in the hot focal point situated in the low zone and condenses in the high zone, and then returns due to the gravity action (evaporative thermosyphon); 4) Peltier effect elements (first step); 5) Thermosyphon which transports the heat to the cold faces of the Peltier effect pastilles of the first step; 6) Thermosyphon which exchanges the heat with the prior thermosyphon and transports said heat from the hot faces to the Peltier pastilles of the second step; 7) Peltier effect elements (second step). 8) Thermosyphon which transports the heat from the container at low temperature or at frozen good temperature to the cold faces of the Peltier plates of the second step. The four fluids can be water with various vacuum levels.

6 Claims, 1 Drawing Sheet

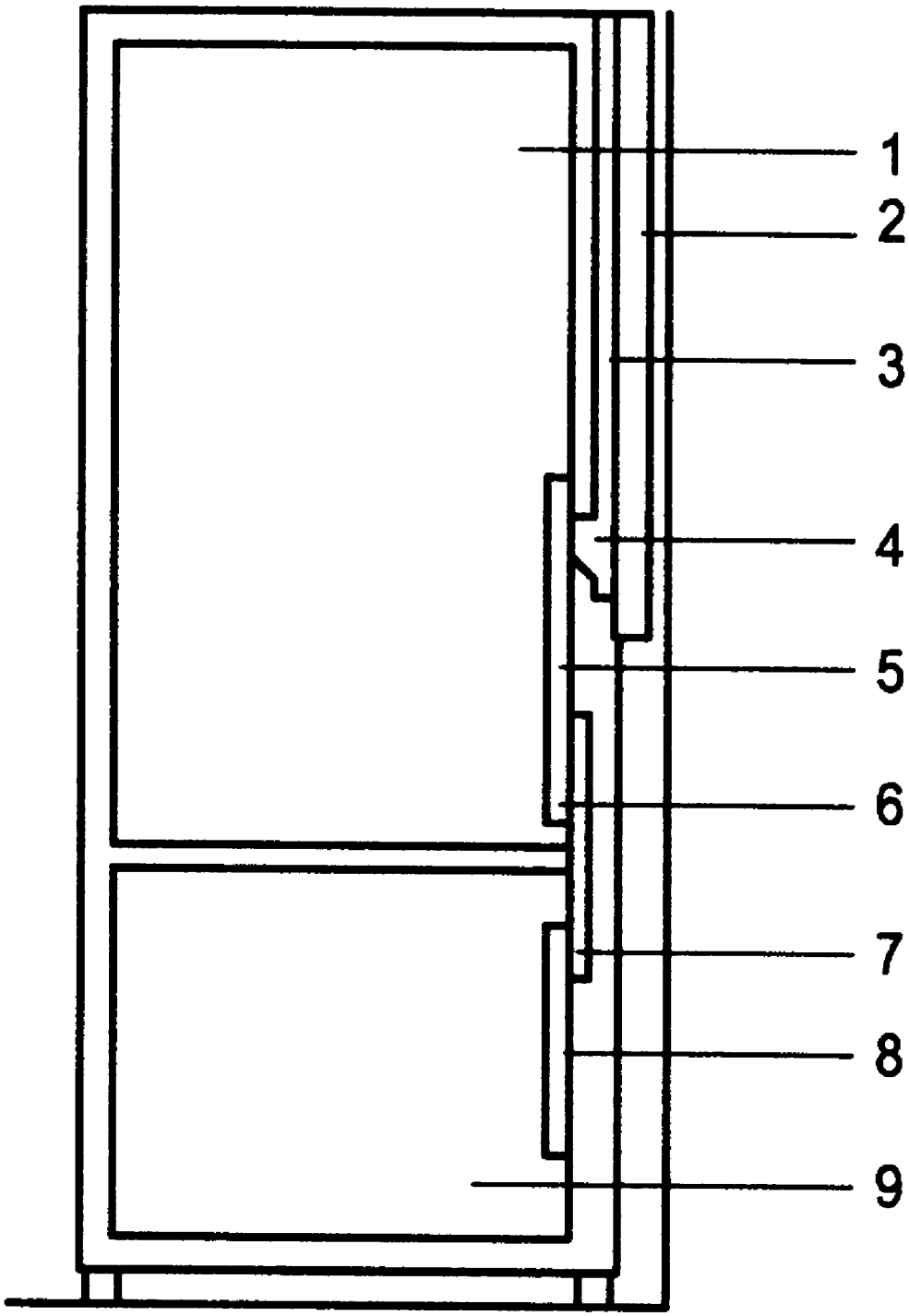
1
2
3
4
5
6
7
8
9

DOMESTIC REFRIGERATOR WITH PELTIER EFFECT, HEAT ACCUMULATORS AND EVAPORATIVE THERMOSYPHONS

BACKGROUND OF THE INVENTION

Field of the Invention

Systems for producing refrigeration have been developed according to Application requirements. There are basically three fundamental types: absorption, compression and thermoelectricity. Their basic principles are well known: removing heat from one place and taking it to another with a higher temperature and an energy input being required to do so. If the latter is thermal, they are the absorption systems, if mechanical, they are compression and if electrical, they are Thermoelectric or Peltier systems. There are other more direct ones which remove heat and take it from a warmer place to another colder one, using heat or mass transmission mechanisms or using the evaporation of a liquid or the sublimation of a solid.

Most of these systems use phase exchange heat, particularly the liquid-vapour one. The substances most used as refrigeration producing fluids or refrigerants are: anhydrous ammonia, CFCs and CMCF made up of methane and ethane with atoms of chlorine and fluor, the use of which is being forbidden or reduced because of environmental pollution problems, particularly through attacking the atmosphere's ozone layer.

The refrigerating machine used to produce heat and pump it from low to high temperatures is also well known. It is called "heat pump" and is under full development.

"Heat pipes" are also known for removing heat, although their use is not widespread. They consist in sealed enclosures, normally tubular, where there is a liquid and its vapour and, on occasions, a wick or muslin up through which the liquid phase seeps by capillarity. Placed vertically or with a certain slope, they can be used as refrigeration producers.

Both heat pipes and the use of Peltier effect pellets were combined in the patent entitled "Refrigeration installations with heat pipes and Peltier effect for domestic and commercial uses" owned by Consejo Superior de Investigaciones Cientificas, C.S.I.C., i.e., by the applicant therefor, of which three of the authors of this new patent are authors. Water with a certain degree of vacuum was also indicated therein as a fluid in the hot and cold area.

In putting the invention into practice, it was seen that the evaporation-condensation circuit should not be the same as the condensate return circuit, because of possible liquid hammer or retentions and that the thermosyphon type circuit, a mechanism similar to rain's, was preferable.

The use of Peltier effect Pellets for camping fridge refrigeration is generalized and well known. The hot face heat is dissipated through a heat exchanger, which is usually of finned aluminium, via forced air circulation using a fan; the cold produced on the other face of the Peltier is taken through a metal, generally aluminium, to a tank which is also of metal and of the same material. In larger installations, such as hotel refrigerators, fins are usually fitted on the aluminium on the cold side and in some cases, dissipation is increased with the aid of forced circulation. In some prototypes, static cooling has been performed for the ice forming tray and another with forced air.

The double jump or the coupling of two Peltier effect pellets in series is also well known for increasing the temperature jump. With a good performance each pellet may give a jump of approximately 30° C. To conserve frozen products, temperatures of −18° C. must be reached, so the single jump is not recommended.

In domestic refrigerators or fridges as they are commonly known, there are two well differentiated areas: the conservation area at positive temperatures and the freezer area at temperatures close to −18° C. Some higher performing models are fitted with one to two kilo recipients of a product which stores cold (accumulator) either to extend the conservation of food at low temperatures in electricity cuts or for use as portable or camping fridges or for maintaining the temperature constant for a longer time, thus aiding the refrigeration machine.

There are many patents relating to refrigerators where the cold source varies to that the air circulates by natural convection, inserting trays or deflectors and there may be others as regards the insulation features, depending on the shape and distribution of the cooling elements so that natural convection is suitable and the temperature and humidity microclimates are favourable.

Other patents are related to control systems, with defrosting systems and capillary tubes, which are the lamination elements.

SUMMARY OF THE INVENTION

This invention consists in combining the advantages provided by Peltier effect cooling with that of thermosyphon circuits with liquid-vapour phase changes, the phase changes occurring in the places and at the temperatures desired, using gravity for the liquid phase to return to the hot area to be refrigerated and accumulation of heat with a change of phase at the temperature desired to stabilize the system. This facilitates temperature regulation and allows for energy to be available for normal stoppage or abnormal stoppage due to an electricity supply fault or when the control systems operate, etc.

It must be borne in mind that the performance of a heat exchanger depends on the transfer area and surface coefficients. In the base of boiling fluids, such are very high, but in the case of air at very low speeds and, furthermore, at very low temperatures and high humidities, when frost forms, they are very low and the exchange surfaces need to be increased.

In many applications of this type, noise and vibrations from compressors and fans and possible accelerator pumps for carrying the cold from one part to another in the installations are annoying and any moving body always has a reduced lifetime.

Moreover, it must be borne in mind that the heat load in any refrigeration installation varies in time, which makes it necessary to use suitable systems for regulating capacity or operation cut-off. An installation as that being proposed with several Peltier effect pellets and the possibility of supplying them with variable electric currents governed by thermostats through relays, extraordinarily minimizes these problems. Highly reduced temperature and humidity variations may be obtained which extend the quality of stored perishable products.

This patent displays the following advantages compared to the previous state of the art.

With respect to compression systems Suppression of noise and vibrations, longer life, non polluting, better temperature and humidity control, simpler to build and maintain and cheaper in certain types. With respect to absorption systems.

The high pressures are avoided in those which do not use pumps (which prevent leaks occurring), the major levelling problems are eliminated, the designs are simplified, complex jigs requiring long series to pay for them are not necessary and costs and yields are lower, With respect to the current Peltier effect systems Greater performances, elimination of moving parts, improvements in relative humidity and temperature, reduction of heat entering enclosures to be cooled, through the Peltier pellets, in stoppages.

BRIEF DESCRIPTION OF THE DRAWINGS

The FIGURE is a schematic representation of a refrigerator according to the invention.

DESCRIPTION OF THE PREFERRED EMBODIMENT

The enclosure to be refrigerated may be one or two thermally insulated compartments where air circulates by natural convection (it may be forced, as an option). Two numbers (1) and (9) are shown in the figure. The heat entering each of the two enclosures and that which stored products, door opening, etc. may produce is removed by evaporation of a liquid, which may be water and its vapour is condensed in the top of the closed enclosure where the cold faces of the Peltier pellets are installed. Thermosyphons (5) and (8). The Peltier pellets pump this heat to the hot faces and electric power which is turned into heat has to be used. This latter heat has to be removed through the hot faces through the two thermosyphons (3) and (6). All the heat to be removed from the enclosures plus that produced by the Joule Effect in the pellets has to be removed through the exchanger or dissipator (2). This is why the phase change temperature of the thermosyphon (3) has to be a few degrees above the maximum ambient temperature. In the figure this has been taken as 32° C. The discipator may be finned or have some other type of additional surfaces.

In the case of the heat dissipator and the thermosyphon (3), if the fluid is water, it will boil in the area close to the hot faces of the pellets and will condense on the finned surface which will cool down by air in natural convection (forced as an option).

The Peltier effect pellets to be used and their number will depend on the domestic refrigerator's features, on the rating required and the insulator type and thickness. It has to be supplied with direct current at the current most suited to the temperature jump desired (increase between 30 and 40° C.). Apart from acting as a transport vehicle, the liquid introduced into each thermosyphon acts as a heat accumulator. As an option, some thermosyphon or all of them may be replaced by a very good heat conducting element, which might be metal or plastic with carbon fibre and heat accumulators with eutectic mixtures.

EXAMPLE

As an example of an embodiment of the invention, a domestic fridge has been chosen, with capacities in the refrigeration area of 167.5 liters (temperature between 0 and 6° C.) and in the freezing area, 105 liters (temperature between −18° C. and −20° C.) which can freeze 21 Kg per day of food containing 85% water. Mean ambient temperature 23° C. The insulation would be expanded polyurethane with a density of 40 kg/m3, coefficient of heat conductivity 0.023 w/m.k, thickness of both enclosures 6 cm.

| | |
|---|---|
| Capacity of first accumulator, Kg | 0.3 |
| Capacity of first accumulator, Kwh | 11.97 |
| Temperature of first accumulator, ° C. | 35 |
| Maximum ambient temperature, | 32 |
| First circuit's dissipation area, m2 | 6 |
| First circuit's overall coefficient, W/m2.K | 12 |
| Rating of heat to be removed from first circuit, W | 449 |
| Capacity of intermediate thermosyphons, Kg | 0.15 |
| Refrigeration capacity of intermediate thermos., Kw/h | 0.84 |
| Refrigeration rating of first refrigeration circuit, W | 6.3 |
| Refrigeration rating of first circuit for second stage, W | 129.7 |
| Area of refrigerator cooler, m2 | 0.53 |
| Capacity of freezer therm., Kg | 0.15 |
| Cold capacity of freezer therm., Kwh | 0.84 |
| Refrigeration rating of freezer, W | 26.4 |
| Area of freezer cooler, m2 | 0.33 |
| Freezing capacity, Kg/day | 21.4 |

| Peltier Pellets | |
|---|---|
| Refrigeration rating, W | 21 |
| Heating rating, W | 64.7 |
| Electricity consumption, W | 43.7 |
| No. of pellets, first jump | 8 |
| No. of pellets, second jump | 2 |
| Refrigeration operating ratio, % | 86.7 |
| Freezing operating ratio, % | 62.9 |
| Electricity consumption, W | 358.2 |
| Total electricity consumption, year, kwh | 3158 |

The pressures of the four circuits may be theoretically or experimentally obtained. As regards the latter, in the following way: the equipment is taken to an environment whose temperature is the maximum design plus three degrees (35° C.). If the former is 32° C., a few hours are taken until its temperature stabilizes and it is turned into a vacuum with a rotary pump. It is connected to a water recipient at the chamber's temperature and is left to suck in the amount desired and the vacuum is made again until the water boils. The temperature is reduced or it is taken to ambient temperature and once the latter is reached, the pressure is measured, which will be the circuit fill pressure of the future manufacturing series.

This operation would be performed in a similar fashion with the other temperatures desired in the other three circuits, temperatures of −5° C. and −3° C. for environment at 4° C. and −24° C. for −20° C. and the pertinent pressures can be measured.

The pellets would be electrically supplied with direct current at the suitable voltage for the current to be the optimum under nominal design conditions. It is recommendable to obtain it experimentally in each prototype model. It is recommended that the pellet supply be divided into two separate electrical circuits. For example, if ten are used (eight for the first jump and two for the second), supply five in series (4+1), if the optimum voltage is 11.5 v per pellet, the voltage would be 57.5 v for each of the two circuits.

Another voltage of 30% could be availed of, i.e., 17.25 v for switching in the event the thermostat had reached the desired temperature. Thermostats could be sited in both enclosures or in the thermosyphons cooling them.

APPLICATIONS

Domestic and commercial refrigerators.

Food display units

Climatic chambers

Office or hotel refrigerators

Features shown in the figure of the drawing include:

Domestic refrigerators with two insulated departments for keeping refrigerated produces at the top (1) and frozen at the bottom (2)

Heat discipator with additional surfaces (2)

Peltier pellets, first jump (4), second jump or stage (7)

Evaporative thermosyphons at several temperatures (3), (5), (6) and (8)

Refrigeration enclosure cooler (5)

Freezer enclosure cooler (8)

We claim:

1. A household refrigerator cooled with the Peltier effect, comprising:

an enclosure to be cooled, said enclosure having at least one thermally insulated chamber with air circulating by natural convection, said at least one thermally insulated chamber having heat removed therefrom by evaporation of a fluid in said enclosure; and two cascade-coupled units for cooling said at least one thermally insulated chamber, each of said units including:

Peltier effect pellets having cold faces and hot faces;

two thermosyphons connected to each other and separated by said Peltier effect pellets, each of said two thermosyphons housing the fluid;

one of said two thermosyphons condensing the fluid at least at one of said cold faces; and another of said two thermosyphons evaporating the fluid at least at one of said hot faces.

2. The refrigerator according to claim 1, wherein each of said two thermosyphons has:

a first flow circuit for conveying evaporated fluid to where the fluid is to be condensed; and a second flow circuit for conveying condensed fluid to where the fluid is to be evaporated.

3. The refrigerator according to claim 2, wherein said second flow circuit is different from said first flow circuit.

4. The refrigerator according to claim 1, wherein said at least one thermally insulated chamber is two thermally insulated chambers.

5. The refrigerator according to claim 1, wherein at least one of said two thermosyphons causes evaporation of said fluid to remove heat from said hot faces of said pellets in one of said cascade-coupled units, and including an ambient air exchanger for condensing said fluid, said ambient air exchanger disposed above said pellets for returning by gravity said fluid condensed.

6. The refrigerator according to claim 2, wherein:

said fluid is water;

said two thermosyphons contain said water under vacuum as refrigerating fluid; and evaporation of water as the fluid occurs at a given temperature in at least one of said two thermosyphons.

* * * * *